US007316133B2

(12) United States Patent
No et al.

(10) Patent No.: US 7,316,133 B2
(45) **Date of Patent: *Jan. 8, 2008**

(54) DRUM-TYPE WASHING MACHINE

(75) Inventors: Yang Hwan No, Changwon-si (KR); Jong Seok Kim, Changwon-si (KR); Han Ki Cho, Changwon-si (KR); Yeon Su Jung, Changwon-si (KR); Jung Hoon Kang, Changwon-si (KR); Young Hoon Ha, Masan-si (KR); Myung Sik Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 609 days.

This patent is subject to a terminal disclaimer.

(21) Appl. No.: 10/746,155

(22) Filed: Dec. 29, 2003

(65) Prior Publication Data

US 2004/0187528 A1 Sep. 30, 2004

(30) Foreign Application Priority Data

Dec. 30, 2002 (KR) ..... 10-2002-0086937

(51) Int. Cl.
*D06F 29/00* (2006.01)
*D06F 35/00* (2006.01)

(52) U.S. Cl. ..... 68/17 R; 68/12.18

(58) Field of Classification Search ..... 68/12, 68/18, 17 R

See application file for complete search history.

(56) References Cited

U.S. PATENT DOCUMENTS 2,153,812 A * 4/1939 Newton ..... 166/325

(Continued)

FOREIGN PATENT DOCUMENTS

DE 38 04 328 2/1988

(Continued)

*Primary Examiner*—Michael Barr
*Assistant Examiner*—Jason Heckert
(74) *Attorney, Agent, or Firm*—Ked & Associates, LLP

(57) ABSTRACT

A drum-type washing machine includes a washing water supply apparatus providing a liquid passage from a water outlet of a detergent reservoir to an inner space of a tub. The washing water supply apparatus employs a bubble dissipation device for preventing bubbles generated in a tub from reaching an inlet bellows and entering a detergent reservoir. The washing water supply apparatus includes a water supply duct formed at an upper part of the tub; an inlet bellows, one end of which is coupled to the water outlet of the detergent reservoir and the other end of which is connected to the water supply duct, for supplying a liquid to the tub; and a bubble dissipation device, vertically installed along the liquid passage of the washing water supply apparatus, for preventing bubbles generated in the tub from entering the detergent reservoir. The bubble dissipation device includes a float movably disposed in the washing water supply apparatus to travel a predetermined vertical distance along the washing water supply apparatus between a seated stated and a raised state, under a force of a forming air bubble, for blocking the liquid passage when a bubble is generated and allowing the liquid of the washing water supply apparatus to drain into the tub when no bubble is generated. An air escape hole having a small cross-section, for allowing air trapped by the float to escape slowly back into the tub, provides communication between the inner space of the tub and a space created when the float is in the raised state.

12 Claims, 5 Drawing Sheets

U.S. PATENT DOCUMENTS

| | | | | | |
|---|---|---|---|---|---|
| 2,223,509 | A | * | 12/1940 | Brauer | 137/67 |
| 2,940,467 | A | * | 6/1960 | Smith | 137/432 |
| 2,953,159 | A | | 9/1960 | Geschka et al. | |
| 3,270,529 | A | | 9/1966 | Engel | |
| 3,608,339 | A | | 9/1971 | Mazza | |
| 4,821,537 | A | * | 4/1989 | Zinkann et al. | 68/208 |
| 5,596,889 | A | | 1/1997 | Guerra et al. | |
| 5,687,440 | A | | 11/1997 | Min et al. | |
| 5,768,730 | A | | 6/1998 | Matsumoto et al. | |
| 6,217,770 | B1 | * | 4/2001 | Haney et al. | 210/636 |
| 2004/0187528 | A1 | | 9/2004 | No et al. | 68/17 R |

FOREIGN PATENT DOCUMENTS

| | | |
|---|---|---|
| DE | 197 31 667 | 7/1997 |
| JP | 2-45091 | 2/1990 |
| JP | 10-15272 | 1/1998 |
| JP | 10-235069 | 9/1998 |

* cited by examiner

DRUM-TYPE WASHING MACHINE

This application claims the benefit of Korean Application No. 10-2002-0086937 filed on Dec. 30, 2002, which is hereby incorporated by reference.

BACKGROUND OF THE INVENTION

1. Field of the Invention

The present invention relates to a drum-type washing machine, and more particularly, to a drum-type washing machine having a washing water supply apparatus employing a bubble dissipation means in a water supply duct formed in an upper part of a tub.

2. Discussion of the Related Art

Generally speaking, laundering using a drum-type washing machine is carried out using a frictional force between the laundry and a drum rotatably installed within a tub and receiving the driving force of a motor, using an operation of supplying to the tub a predetermined amount of washing water, i.e., water into which detergent, softening agents, and the like have been dissolved. To supply washing water as above, such a washing machine typically includes a washing water supply apparatus providing a liquid passage for the inner space of the washing machine to communicate with a detergent reservoir, having compartments for storing a detergent and a softening agent. A conventional washing water supply apparatus is comprised of a water supply duct formed at an upper part of the tub and an inlet bellows, one end of which is coupled to the detergent reservoir and the other end of which is tightly connected to the water supply duct, to allow the passage of liquid (washing water) in the detergent reservoir to the inner space of the tub.

Conventionally, the detergent reservoir is disposed above the tub and is supplied with water from an external water source, which mixes with the contents of the reservoir's compartments and is then supplied as washing water to the tub through the inlet bellows. The detergent reservoir is essentially a water supply passage having a water outlet formed at one end, so that the washing water is allowed to exit the detergent reservoir and travel down the inlet bellows to the tub, entering the tub at the water supply duct. Thus, the inner space of the tub communicates with the detergent reservoir via the washing water supply apparatus.

During operation, however, air bubbles formed of the washing water in the tub are inherently generated inside the tub when the drum is rotated, and the bubble surfaces contain laundry dirt, detergent, and the like. The generation of bubbles is particularly great when a large amount of detergent is present in the washing water or when the rotation speed of the drum is great. The bubbles of air escape from the tub through the water supply duct and the inlet bellows, to enter the detergent reservoir and thus contaminate the detergent reservoir and its contents.

SUMMARY OF THE INVENTION

Accordingly, the present invention is directed to a drum-type washing machine that substantially obviates one or more of the problems due to limitations and disadvantages of the related art.

An object of the present invention, which has been devised to solve the foregoing problem, lies in providing a drum-type washing machine having a washing water supply apparatus employing a bubble dissipation means for preventing bubbles generated in a tub from reaching an inlet bellows and entering a detergent reservoir.

It is another object of the present invention to provide a drum-type washing machine having a washing water supply apparatus, which prevents a contamination of a detergent reservoir or its contents.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a drum-type washing machine having a washing water supply apparatus providing a liquid passage from a water outlet of a detergent reservoir to an inner space of a tub. The washing water supply apparatus comprises a water supply duct formed at an upper part of the tub; an inlet bellows, one end of which is coupled to the water outlet of the detergent reservoir and the other end of which is connected to the water supply duct, for supplying a liquid to the tub; and bubble dissipation means, vertically installed along the liquid passage of the washing water supply apparatus, for preventing bubbles generated in the tub from entering the detergent reservoir. The bubble dissipation means is preferably installed in the water supply duct of the washing water supply apparatus and comprises a float movably disposed in the washing water supply apparatus to travel a predetermined vertical distance along the washing water supply apparatus between a seated stated and a raised state, under a force of a forming air bubble, for blocking the liquid passage when a bubble is generated and allowing the liquid of the washing water supply apparatus to drain into the tub when no bubble is generated.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT

Reference will now be made in detail to the preferred embodiment of the present invention, examples of which are illustrated in the accompanying drawings. Throughout the drawings, like elements are indicated using the same or similar reference designations.

Figure 1:
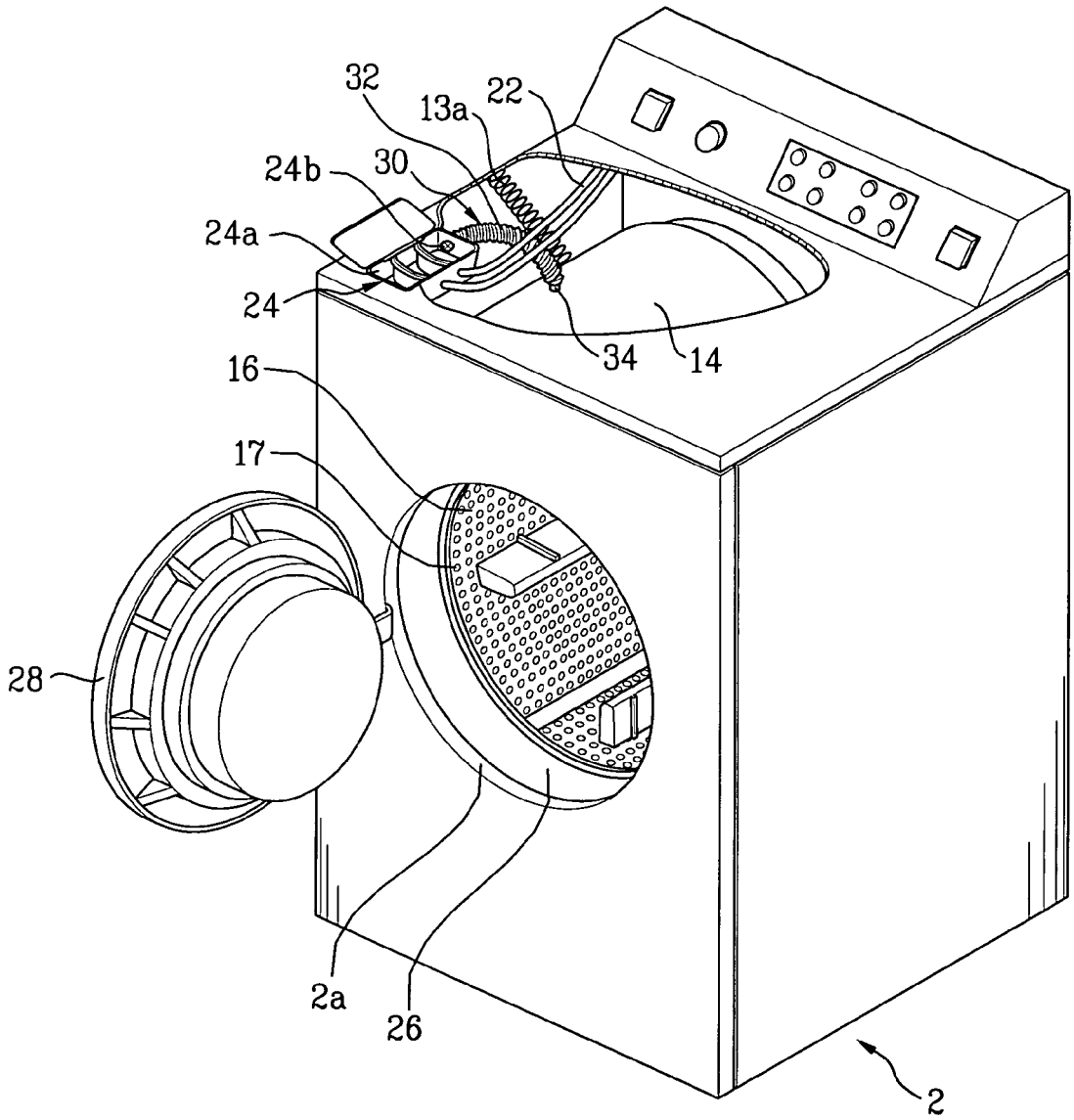
FIG. 1 is a partially cutaway perspective view of the drum-type washing machine according to the present invention.
Figure 2:
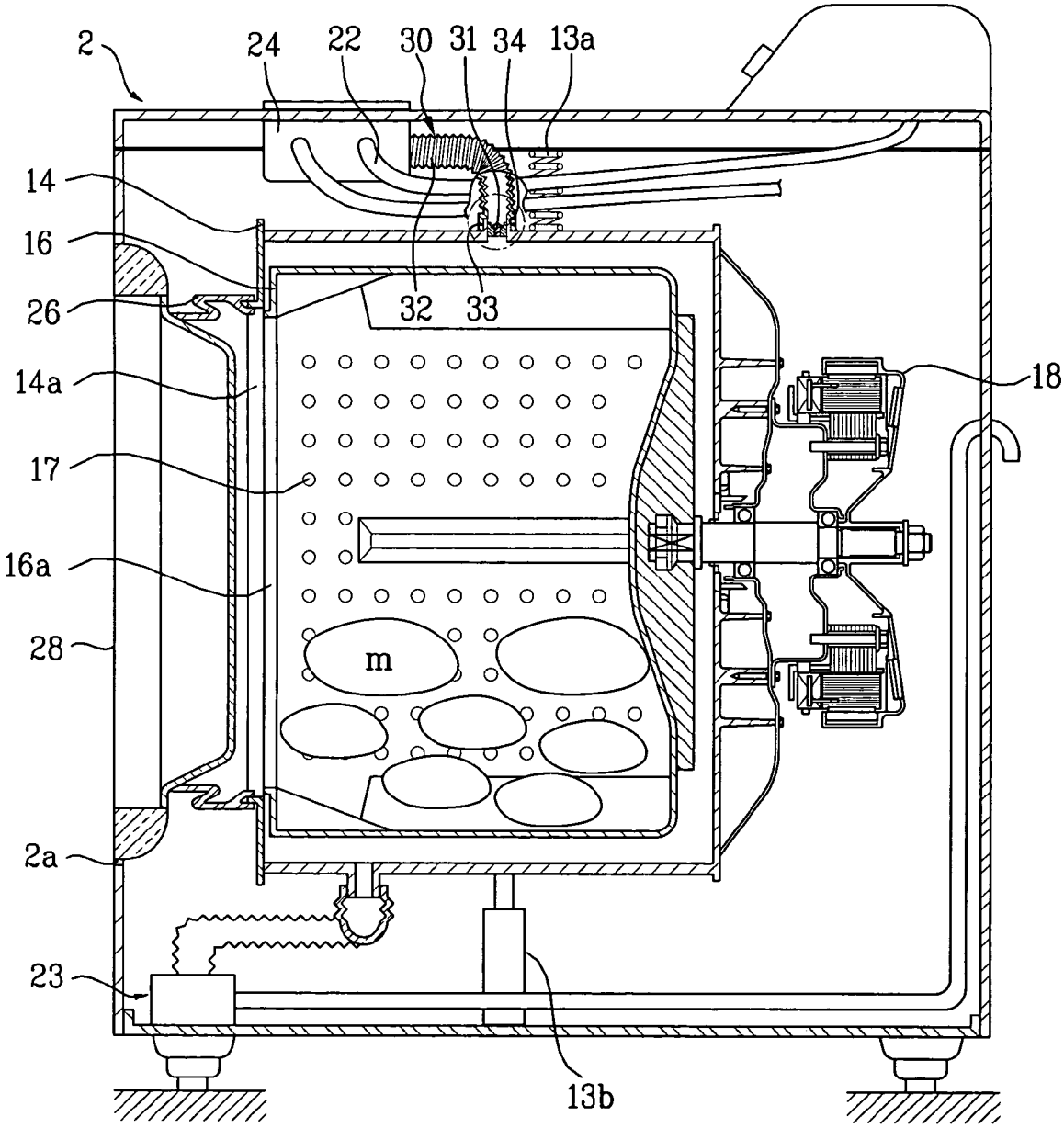
FIG. 2 is a cross-sectional side view of the interior of the drum-type washing machine shown in FIG. 1, highlighting the washing water supply apparatus of the present invention.

Referring to FIGS. 1 and 2, a drum-type washing machine according to the present invention is comprised of a cabinet 2 having a front surface in which a laundry entrance 2*a* is centrally formed; a tub 14, installed to be supported in the cabinet by an interoperation of a spring 13*a* and a damper 13*b*, having a forward tub opening 14*a* corresponding to the laundry entrance; a drum 16 for accommodating laundry m, rotatably disposed in the tub, having a forward drum opening 16*a* corresponding to the laundry entrance and a multitude of dewatering holes 17 formed in its circumferential side surface; a driving motor 18, mounted on a rear surface of the tub, for rotating the drum; a detergent reservoir 24 for storing a detergent and a softening agent, disposed above the tub and communicating with a water supply hose 22 for connection to a water source (not shown), the detergent reservoir having a water supply passage 24*a* for passing water through the detergent reservoir during washing and rinsing operations and a water outlet 24*b* formed at one end of the water supply passage; a water discharging device 23 for discharging water from the tub; a gasket 26, connecting the forward tub opening to the laundry entrance of the cabinet and thereby preventing spillage between the tub and cabinet; a door 28 mounted in the laundry entrance of the cabinet; and a washing water supply apparatus 30 providing a liquid passage from the water outlet of the detergent reservoir to the inner space of the tub.

The washing water supply apparatus 30 comprises a water supply duct 34 formed at an upper part of the tub 14; an inlet bellows 32, one end of which is coupled to the water outlet 24*b* of the detergent reservoir 24 and the other end of which is tightly connected to the water supply duct, for supplying washing water to the tub; and a bubble dissipation means 31, vertically installed in the water supply duct of the washing water supply apparatus, for preventing bubbles generated in the tub from reaching the inlet bellows and entering the detergent reservoir. While the bubbles are stopped by the bubbles dissipation means 31, the liquid (washing water) traveling through the washing water supply apparatus 30 is allowed to drain from the water outlet 24*b* of the detergent reservoir 24 to the inner space of the tub 14. The inlet bellows 32 is tightly secured to an upper end of the water supply duct 34 with a clamp 33, to create a seal between the inlet bellows and the water supply duct and to avoid inadvertent separation of the inlet bellows from the water supply duct.

Figure 3:
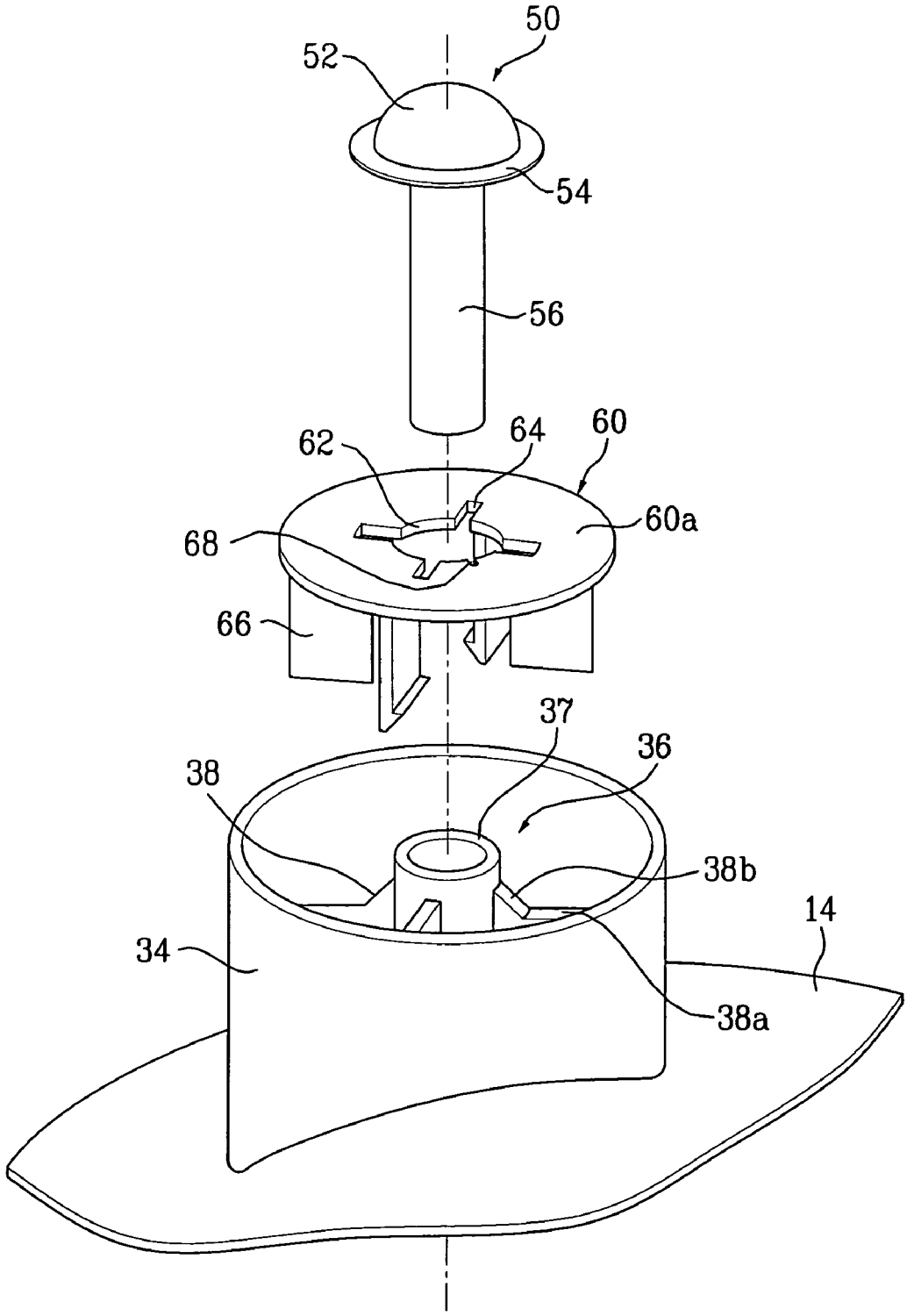
FIG. 3 is an exploded perspective view of the water supply duct and bubble dissipation means of FIG. 2.
Figure 4:
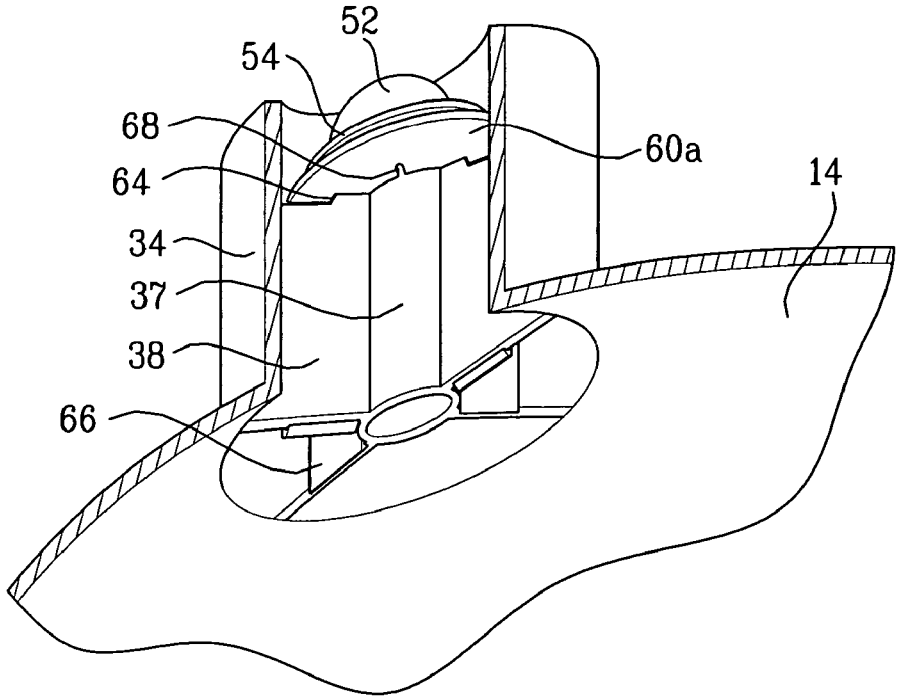
FIG. 4 is a partially cutaway perspective view of the water supply duct and bubble dissipation means of FIG. 2.

Referring to FIGS. 3 and 4, the bubble dissipation means 31 comprises a fixed guide 36 formed on an inner circumferential surface of the water supply duct 34 of the washing water supply apparatus 30; a float 50, movably disposed in the water supply duct of the washing water supply apparatus by traveling a predetermined vertical distance along the fixed guide between a seated stated and a raised state, under the force of a forming air bubble, for momentarily closing the mouth of the inlet bellows 32 and thus temporarily blocking the liquid passage of the washing water supply apparatus when bubbles are generated and allowing the liquid of the washing water supply apparatus to drain into the tub 14 when no bubbles are generated; and an air intercepting plate 60, fixed to the fixed guide and disposed under the float, for intercepting air passing through the water supply duct toward the inlet bellows. The bubble dissipation means 31 is provided with an air escape hole 68 having a small cross-section, communicating between the inner space of the tub 14 and a space created when the float 50 is in a raised state, for allowing air trapped by the float to escape slowly back into the tub 14 and thereby allow the float to lower when a bubble dissipates. The air escape hole 68 is small enough to restrict airflow, and thus slow the lowering of the float 50, but large enough to prevent the generation of noise as the float is lowered into its seated position.

Though shown in the drawings as being installed in the water supply duct 34, it should be appreciated that the same effect may be achieved by installing the bubble dissipation means 31 elsewhere along the washing water supply apparatus 30.

The fixed guide 36 comprises a cylindrical sleeve 37, centrally positioned in the water supply duct 34, having an outer diameter to allow seating of the air intercepting plate 60 and having an inner diameter for receiving the float 50 with a substantially vertical orientation; and a plurality of radial ribs 38, radiating at a constant interval from the cylindrical sleeve to an inner surface of the water supply duct, to support the cylindrical sleeve in the center of the water supply duct. The upper edge of each of the radial ribs 38 has a horizontal surface 38a formed next to the water supply duct 34 and an inclined portion 38b extending from the horizontal surface and sloping upward to the cylindrical sleeve 37.

The float 50 comprises a cylindrical rod 56 to be received by the cylindrical sleeve 37 of the fixed guide 36 and enable guiding by the fixed guide, the cylindrical rod forming a hollow shaft extending between an open upper end and an open lower end; a hemispherical head 52, formed at the open upper end of the cylindrical rod, having a smaller diameter than an inner diameter of the inlet bellows 32, to protrude into the mouth of the inlet bellows; and an annular rib 54, projecting from a lower perimeter of the hemispherical head, having a diameter greater than the inner diameter of the inlet bellows, to engage with the mouth of the inlet bellows so that the float is largely retained in the water supply duct 34, but having a diameter smaller than the inner diameter of the water supply duct to allow liquid to drain from the inlet bellows. The hemispherical head 52 is in essence a hollow dome communicating with the cylindrical rod 56, to form an air chamber facilitating the buoyancy of the float 50, whereby the hemispherical head and cylindrical rod impart a buoyancy sufficient to lift the float under the force of a forming air bubble. Thus, the float 50 is lifted by bubbles filling and rising in the water supply duct 34 of the tub 14, which cause the float to slide up along the cylindrical sleeve 37 of the fixed guide 36 and close the inlet bellows 32 when bubbles are generated. After the dissipation of the bubbles, the float 50 slides back down and becomes seated in the cylindrical sleeve 37 of the fixed guide 36, to rest atop the air intercepting plate 60.

The air intercepting plate 60 comprises a disc 60*a* having a diameter greater than the annular rib 54 of the float 50, to prevent a false operation of the float (i.e., becoming unseated in the absence of bubble generation) by a flow of air due to a sudden pressure change in the washing machine when the door 28 is closed; and a plurality of hooking planes 66 extending from the bottom surface of the disc to correspond to the radial ribs 38 of the fixed guide 36, to be respectively hooked on a lower edge of the radial ribs such that the disk is firmly seated on the horizontal surfaces 38*a* of the radial ribs. The hooking planes 66 fix the air interrupting plate 60 to the fixed guide 36 to prevent a lifting of the air interrupting plate by air passing through the water supply duct 34 and entering the inlet bellows 32. A center hole 62, having a diameter for receiving the cylindrical sleeve 37 of the fixed guide 36, is centrally formed in the disk 60*a* of the air interrupting plate 60, and a plurality of radial slits 64 are formed in the perimeter of the central hole, for respectively receiving the inclined portions 38b of the radial ribs 38, to determine a seating orientation of the air interrupting plate. The air escape hole 68, for allowing air trapped by the float 50 to escape slowly back into the tub 14, is formed at a predetermined position of the perimeter of the center hole 62.

Figure 5:
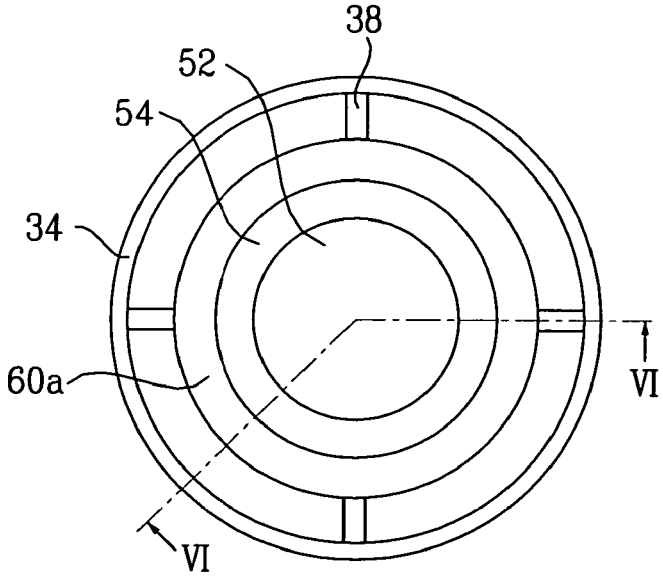
FIG. 5 is a plan view of the water supply duct and bubble dissipation means of FIG. 2.
Figure 6A:
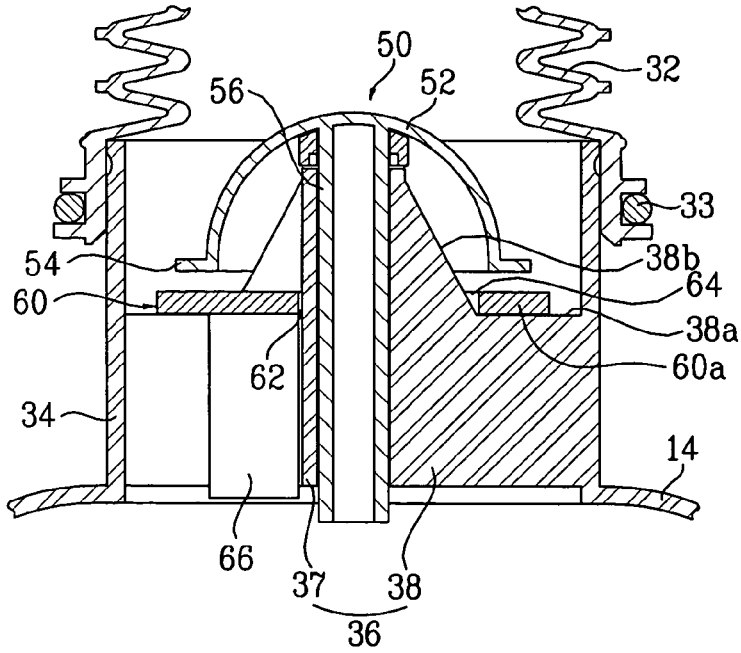
FIG. 6A is a cross-sectional view of the washing water supply apparatus of the present invention, as if along a line VI-VI of FIG. 5, illustrating the float of the bubble dissipation means in a seated state, i.e., without a generation of bubbles in the tub.
Figure 6B:
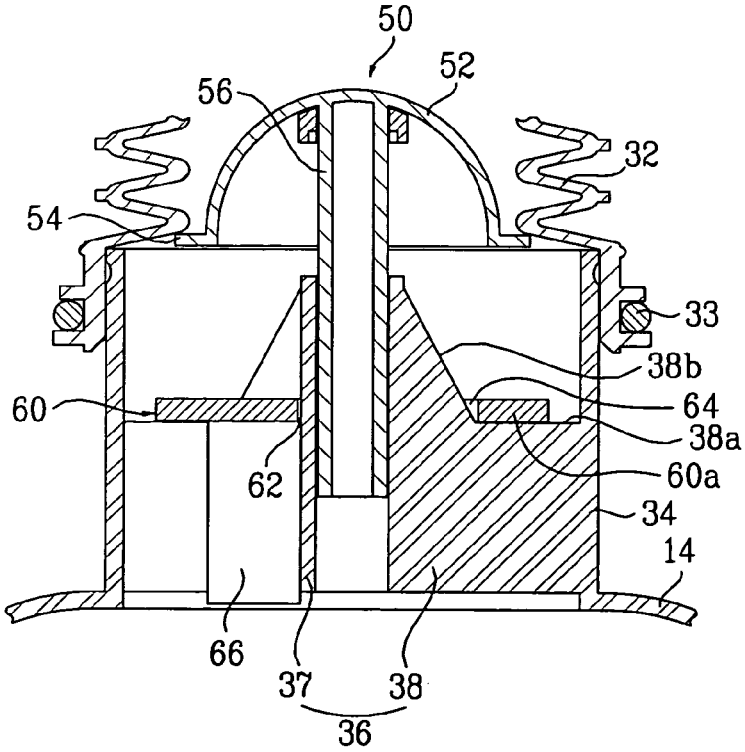
FIG. 6B is a cross-sectional view of the washing water supply apparatus of the present invention, as if along a line VI-VI of FIG. 5, illustrating the float of the bubble dissipation means in a raised state, i.e., with a generation of bubbles in the tub.

Referring to FIG. 5 and FIGS. 6A and 6B illustrating the operation of the washing water supply apparatus 30 configured as above, with laundry in the drum 16 and water from the external water source provided to the detergent reservoir 24, the water mixes with the reservoir's contents to produce washing water, which exits the detergent reservoir though the water outlet 24*b* and travels down the inlet bellows 32 and to the water supply duct 34 of the tub 14. In doing so, the washing water drains between the perimeter of the float 50 and the inner circumferential surface of the water supply duct 34, guided by the shape of the hemispherical head 52 at the top of the float, and enters the tub 14. Meanwhile, as the drum 16 is rotated in washing water filling the tub 14 and bubbles are thus generated, air flows out of the tub and into the water supply duct 34 where the bubbles are formed.

The float 50 is raised to a predetermined height under the force of the forming bubbles, guided by the cylindrical rod 56 sliding up the cylindrical sleeve 37 of the fixed guide 36, thus closing off the inlet bellows 32 and preventing the bubbles from entering the inlet bellows. As long as the bubbles are present under the hemispherical head 52, the float 50 is held in the raised position and the mouth of the inlet bellows 32 is closed. As soon as the bubbles dissipate (burst), or are no longer generated in the tub 14, the air trapped by the float 50 escapes though the air hole 68 and flows back into the tub, whereby the float is slowly lowered by its own weight.

As described above, a drum-type washing machine having a washing water supply apparatus according to the present invention comprises a bubble dissipation means for preventing bubbles generated in the tub from reaching the inlet bellows of the washing water supply apparatus and entering the detergent reservoir, while allowing the liquid of the washing water supply apparatus to drain into the tub from the detergent reservoir. In doing so, a float is lifted along a fixed guide by the generation of bubbles in the tub, closing the inlet bellows of a washing water supply apparatus until the dissipation of the bubbles occurs, and an air intercepting plate prevents a false operation of the float by intercepting a flow of air beneath the float. In preventing the discharge of bubbles from the tub as above, the washing water supply apparatus prevents a contamination of the detergent reservoir and its contents, and since a lifting and lowering of the float is guided by the fixed guide, with its buoyancy facilitated by an air chamber formed in its hemispherical head to protrude into the inlet bellows upon bubble generation, the prevention of bubble discharge is achieved accurately and rapidly while supplying washing water to the tub as desired.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A drum-type washing machine having a washing water supply apparatus providing a liquid passage from a water outlet of a detergent reservoir to an inner space of a tub, the washing water supply apparatus comprising:

a water supply duct formed at an upper part of the tub;

an inlet bellows, one end of which is coupled to the water outlet of the detergent reservoir and the other end of which is connected to said water supply duct, for supplying a liquid to the tub; and a float movably disposed in the liquid passage to travel a predetermined vertical distance along the liquid passage between a seated stated and a raised state, under a force of a forming air bubble, for blocking the liquid passage when a bubble is generated and allowing liquid of the washing water supply apparatus to drain into the tub when no bubble is generated.

2. The drum-type washing machine as claimed in claim 1, wherein said float is installed in said water supply duct of the washing water supply apparatus.

3. The drum-type washing machine as claimed in claim 1, wherein an air escape hole having a small cross-section, for allowing air trapped by said float to escape slowly back into the tub, provides communication between the inner space of the tub and a space created when said float is in the raised state.

4. The drum-type washing machine as claimed in claim 1, further comprising:

an air intercepting plate, fixed with respect to the liquid passage of the washing water supply apparatus and disposed under said float, for intercepting air passing through said water supply duct toward said inlet bellows and thereby preventing a false operation of said float; and a fixed guide, fixed to an inner circumferential surface of the liquid passage, for guiding a movement of said float along the predetermined vertical distance of the washing water supply apparatus.

5. The drum-type washing machine as claimed in claim 4, wherein said air intercepting plate is fixed to said fixed guide.

6. The drum-type washing machine as claimed in claim 4, wherein said float comprises:

a cylindrical rod to be received by said fixed guide and enable guiding by said fixed guide, said cylindrical rod forming a hollow shaft extending between an open upper end and an open lower end;

a hemispherical head, formed at the open upper end of said cylindrical rod, having a smaller diameter than an inner diameter of the liquid passage of the washing water supply apparatus; and an annular rib, projecting from a lower perimeter of said hemispherical head, having a diameter greater than the inner diameter of the inlet bellows of the washing water supply apparatus but having a diameter smaller than the inner diameter of said water supply duct.

7. The drum-type washing machine as claimed in claim 6, wherein said hemispherical head and cylindrical rod form an air chamber imparting a buoyancy sufficient to lift said float under the force of a forming air bubble.

8. The drum-type washing machine as claimed in claim 1, further comprising an air intercepting plate, fixed with respect to the liquid passage of the washing water supply apparatus and disposed under said float, for intercepting air passing through said water supply duct toward said inlet bellows and thereby preventing a false operation of said float.

9. The drum-type washing machine as claimed in claim 8, wherein said air intercepting plate has an outer diameter greater than that of said float but less than an inner diameter of the liquid passage of the washing water supply apparatus.

10. The drum-type washing machine as claimed in claim 1, further comprising a fixed guide, fixed to an inner circumferential surface of the liquid passage, for guiding a movement of said float along the predetermined vertical distance of the washing water supply apparatus.

11. The drum-type washing machine as claimed in claim 10, wherein said fixed guide comprises:

a cylindrical sleeve for receiving said float; and a plurality of radial ribs, radiating at a constant interval from said cylindrical sleeve to the inner circumferential surface of the liquid passage, to support said cylindrical sleeve.

12. The drum-type washing machine as claimed in claim 11, wherein each of said plurality of radial ribs includes a horizontal surface formed next to the inner surface of the liquid passage and an inclined portion extending from the horizontal surface and sloping upward to said cylindrical sleeve.

* * * * *